US005159309A

United States Patent [19]

Bayer

[11] Patent Number: 5,159,309

[45] Date of Patent: Oct. 27, 1992

[54] SOLDER PELLET

[75] Inventor: Helmut Bayer, Vienna, Austria

[73] Assignee: Electrovac, Fabrikation Elektro-Technischer Spezialartikel Gesellschaft m.b.H., Vienna, Austria

[21] Appl. No.: 775,013

[22] Filed: Oct. 11, 1991

[30] Foreign Application Priority Data

Oct. 18, 1990 [AT] Austria ..... 2102/90

[51] Int. Cl.[5] ..... H01H 37/76; H01H 37/52

[52] U.S. Cl. ..... 337/402; 337/354; 337/407

[58] Field of Search ..... 337/401–417, 337/298, 354, 3, 4, 5

[56] References Cited

U.S. PATENT DOCUMENTS

| | | | |
|---|---|---|---|
| 4,929,922 | 5/1990 | Hollweck | 337/407 |
| 5,014,036 | 5/1991 | Komoto | 337/407 |

FOREIGN PATENT DOCUMENTS

| | | |
|---|---|---|
| 0285044 | 4/1987 | European Pat. Off. . |
| 555951 | 9/1943 | United Kingdom . |
| 2027995 | 2/1990 | United Kingdom . |

*Primary Examiner*—Harold Broome
*Attorney, Agent, or Firm*—Cushman, Darby & Cushman

[57] ABSTRACT

An improved temperature fuse is provided for electrical equipment having a heat transmission plate for holding a solder pellet and a control rod supported on, and prestressed against, the solder pellet. The improvement includes a solder pellet having a metal coating disposed on the entire periphery thereof. The metal coating has a higher melting point than the solder.

10 Claims, 1 Drawing Sheet

SOLDER PELLET

The invention relates to a solder pellet for a temperature fuse for electrical equipment, the fuse having a heat transmission plate for holding the solder pellet and a control rod supported on and prestressed against the solder pellet, the solder pellet melting on reaching a specific temperature and permitting a movement of the control rod.

Solder pellets for temperature fuses for electrical equipment of the type mentioned are known. These generally consist of a solder alloy which melts on reaching the desired temperature and thus permits a movement of the control rod, which is supported on the solder pellet, and which for its part activates control commands.

The disadvantage of the known solder pellets is that, when they are subject to axial pressure of the control rod, they show a pronounced creep behaviour, especially at higher temperatures. This becomes evident by a height reduction of the solder pellets occurring long before reaching melting point, which for its part causes a creeping movement of the control rod and hence also influences the desired activation temperature of the temperature fuse in an undefined manner.

Such solder pellets are used for temperature fusing, e.g. in accordance with DE-PS 2,826,205, in such a manner that they are arranged in a sleeve acting as a corset, the control rod sliding in this sleeve and the solder pellet abutting onto a heat transmission plate.

For reliable and precise activation of the temperature fuse it would however be desirable to have a solder pellet available which shows a stable response until reaching the melting point, i.e. in which no height reduction of the solder pellet occurs as a result of the axial pressure of the control rod before the activation temperature.

The object of the invention is to propose a solder pellet of the type mentioned initially which is characterised by a stable response under axial pressure.

This is achieved according to the invention in that the solder pellet is surrounded on all sides by a metal coating which has a significantly higher melting point than the solder which it encloses.

By means of these measures it is ensured that, in the event of the temperature approaching the melting temperature, the interior of the solder pellet admittedly softens, but is initially held together by the coating which has a significantly higher melting point, so that the solder pellet can withstand the load of the control rod for very long periods and the solder pellet does not break open until the melting temperature of the solder is reached, allowing the control rod to move with respect to the heat transmission plate.

The metal coating of the solder pellet thus results in a rapid height reduction of the solder pellet, which does not occur until the melting point is reached, which for its part causes a rapid movement of the control rod and thus ensures a significantly more precise adherence to the intended activation temperature.

According to a further feature it can be provided that the coating is formed from nickel or a nickel alloy, such as nickel-chromium alloys or nickel-phosphorus alloys.

Such coatings are characterised by high strength and reliably protect the interior of the solder pellet against oxidation which would lead to a change in the properties of the solder.

It can further be provided that the coating is constructed of multiple layers and consists, e.g., of a nickel layer and a chromium layer.

By means of these measures, very good matching of the properties of the coating to the respective requirements can be achieved. Furthermore, according to a further development of the invention, a copper layer can be provided between the metal coating and the solder forming the solder pellet, by which means, in particular, a perfect coating with nickel or nickel alloys can be achieved.

The proposed coatings of nickel and nickel alloys can be applied relatively easily and can be applied onto the solder both galvanically as well as non-electrically.

It can further also be provided that the coating consists of a silver alloy.

In the case of this solution, however, care must be taken to ensure that the selected alloy has a suitable strength.

According to one particularly advantageous embodiment of the invention, the thickness of the metal coating is 0.5 μm to 20 μm, preferably 1 μm to 3 μm, and especially approximately 2 μm.

In this case, the selection of the thickness of the coating provides the capability to influence the strength properties of the solder pellet. The breakdown of the solder pellet is thus displaced more and more with respect to the melting point of the solder alloy, as the coating becomes thicker and stronger. At the same time, a more sudden reduction in the strength of the solder pellet occurs in a temperature range near the melting point of the solder alloy.

The invention is now explained in more detail on the basis of the drawing, in which.

Figure 1:
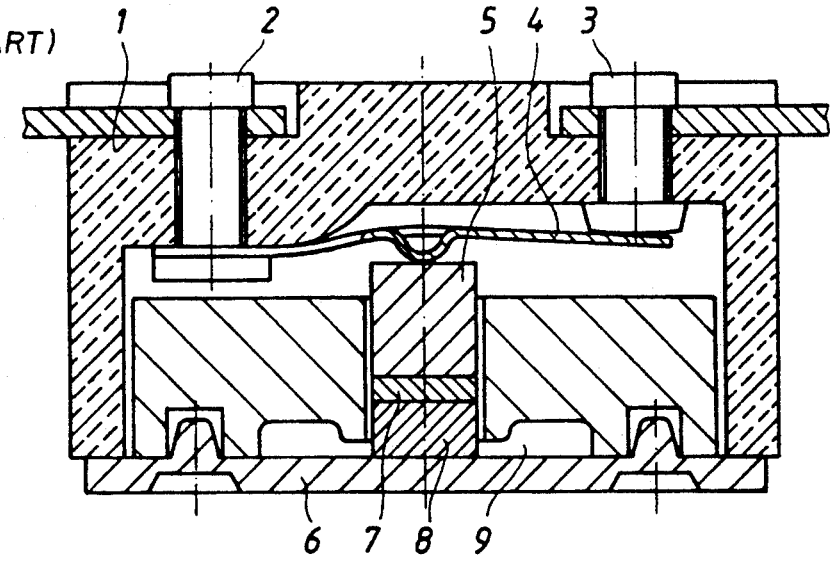
Fig.1 (PRIOR ART)
FIG. 1 shows a temperature fuse.

The temperature fuse has two contacts 2, 3, arranged in a housing 1, on one of which a spring contact 4 is held, which abuts onto the second contact and which presses a control rod 5, guided in a hole of the housing 1, against a heat conducting plate 6, held in the housing 1.

This control rod 5 is supported via a solder stop disc 7 on a solder pellet 8 and presses the latter against the heat conducting plate 6. Alternatively, the control rod 5 can be supported directly on the solder pellet 8.

A surrounding solder catchment chamber 9 is arranged around the guide for the control rod 5.

Figure 2:
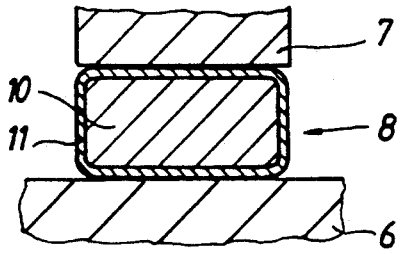
FIG. 2 shows a section through a solder pellet according to the invention.

As can be seen in FIG. 2, the solder pellet 8 has a core 10, consisting of the selected solder alloy, and a coating 11, surrounding this on all sides, consisting of a metal or a metal alloy having a melting temperature which is considerably higher than that of the selected solder alloy of the core 10. This coating can be constructed of multiple layers, e.g. of a nickel layer and a chromium layer. In each case, with a core consisting of a tin-lead alloy, another copper layer can be present, applied directly thereto.

The thickness of this coating can expediently be between 0.5 μm and 20 μm, preferably 1 μm to 3 μm, and particularly approximately 2 μm, increasing thickness resulting in a more rapid response of the height reduction of the solder pellet under axial pressure, with respect to the temperature range near the melting point.

Figure 3:
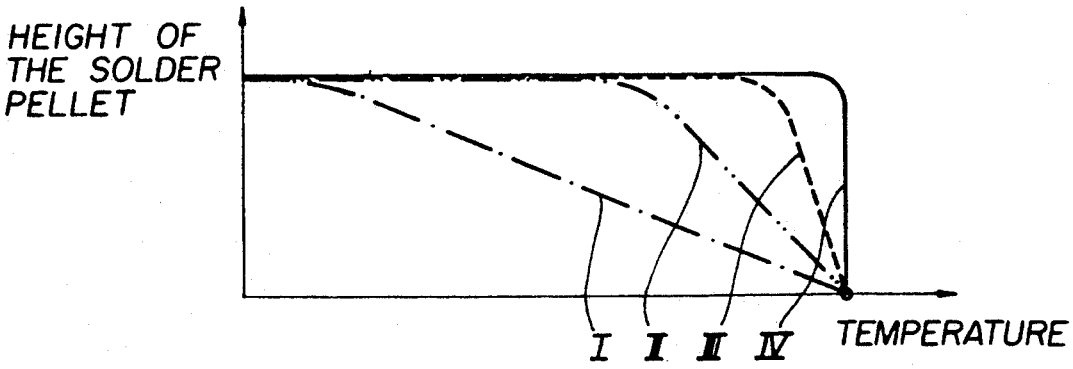
FIG. 3 shows a diagram of the strength/height reduction of the solder pellet under axial pressure, as a function of the temperature.

FIG. 3 thus shows a diagram of solder pellets of the same material with different coating thicknesses.

In this case, the Curve I shows the responses in the case of a conventional solder pellet, without a coating. Such a pellet has a very flat characteristic line, i.e. the height reduction of the solder pellet reduces virtually linearly with increasing temperature.

Curves II and III show the height reduction of different solder pellets 8 according to the invention, the Curve III showing the responses of solder pellets 8 with a thicker coating 11, Curve II, on the other hand showing the responses of solder pellets with a thinner coating.

From FIG. 3 it can be seen that the height reduction of the solder pellet in the case of an axial load as a function of the temperature approximates more and more to the optimum response of height reduction as a function of temperature shown in Curve IV, with increasing thickness of the coating 10.

I claim:

1. A temperature fuse for electrical equipment comprising:

a solder pellet having a metal coating disposed on the entire periphery thereof, said metal coating having a significantly higher melting point than said solder;

a heat transmission plate for holding said solder pellet; and a control rod supported on, and prestressed against, said solder pellet, wherein said solder pellet melts upon reaching a specific temperature, permitting movement of said control rod.

2. The temperature fuse according to claim 1, wherein said coating is formed of nickel or nickel alloy.

3. The temperature fuse according to claim 1, wherein said coating is a nickel-chromium alloy.

4. The temperature fuse according to claim 2, wherein said coating is a nickel-phosphorus alloy.

5. The temperature fuse according to claim 1, wherein said coating comprises multiple layers of different materials.

6. The temperature fuse according to claim 5, wherein the multiple layers are of nickel and chromium.

7. The temperature fuse according to claim 1 or 5, wherein a layer of copper is disposed between said metal coating and the solder forming said solder pellet.

8. The temperature fuse according to claim 1, wherein said coating consists of a silver alloy.

9. The temperature fuse according to claim 1, wherein the thickness of said metal coating is between 0.5 micrometers to 20 micrometers.

10. The temperature fuse according to claim 1, wherein the thickness of said metal coating is between 1 and 3 micrometers.

* * * * *